United States Patent [19]

Staley

[11] Patent Number: 4,870,708

[45] Date of Patent: Oct. 3, 1989

[54] UNDERGARMENT HAVING KNITTED, REINFORCED SOCKS

[76] Inventor: William L. Staley, 1737 Southwood St., Sarasota, Fla. 34236

[21] Appl. No.: 294,283

[22] Filed: Jan. 6, 1989

[51] Int. Cl.[4] ..... A41B 9/02

[52] U.S. Cl. ..... 2/404; 2/409; 2/405; 66/177

[58] Field of Search ..... 2/404, 402, 405, 239, 2/409; 66/177

[56] References Cited

U.S. PATENT DOCUMENTS

| | | | |
|---|---|---|---|
| 256,532 | 4/1882 | Appleton . | |
| 319,131 | 6/1885 | Ryer . | |
| 1,227,217 | 5/1917 | Taylor . | |
| 2,664,570 | 1/1954 | Artzt . | |
| 2,826,760 | 3/1958 | Rice . | |
| 3,020,556 | 2/1962 | Isley | 2/409 |
| 3,194,030 | 7/1965 | Keziah . | |
| 3,595,034 | 9/1971 | Safrit | 66/177 |
| 3,808,842 | 5/1974 | Fisher et al. | 66/177 |
| 3,933,013 | 1/1976 | Cassidy, Sr. . | |
| 3,956,906 | 5/1976 | Cassidy, Sr. . | |
| 4,089,064 | 5/1978 | Chandler | 2/2 |
| 4,091,466 | 5/1978 | Kearn . | |
| 4,133,054 | 6/1979 | Harper . | |
| 4,150,554 | 4/1979 | Cassidy, Sr. . | |
| 4,213,312 | 7/1980 | Safrit | 66/177 |
| 4,267,607 | 5/1981 | Tino | 65/177 |
| 4,368,546 | 1/1983 | White . | |
| 4,445,345 | 5/1984 | Bedier | 66/177 |
| 4,506,392 | 3/1985 | White . | |
| 4,625,336 | 12/1986 | Derderian | 2/409 |

FOREIGN PATENT DOCUMENTS

| | | | |
|---|---|---|---|
| 2909613 | 9/1980 | Fed. Rep. of Germany | 2/409 |
| 9721 | of 1891 | United Kingdom | 2/409 |
| 1210544 | 10/1970 | United Kingdom | 66/177 |
| 1266927 | 3/1972 | United Kingdom | 2/409 |

*Primary Examiner*—Ronald Feldbaum

*Attorney, Agent, or Firm*—Foley & Lardner

[57] ABSTRACT

An undergarment according to the invention combines underpants, socks and leg-covering stockings in a single garment. The sock portions of the garment are reinforced, and are knitted continuously with the leg portions. Such an undergarment can provide men with the benefit of recent developments in fabric and knitting technology, such as light weight, warmth, and streamlined comfort.

9 Claims, 1 Drawing Sheet

UNDERGARMENT HAVING KNITTED, REINFORCED SOCKS

TECHNICAL FIELD

This invention relates to hosiery, particularly to knitted one-piece undergarments which cover the wearer from the waist down.

BACKGROUND OF THE INVENTION

Knitted hosiery such as women's panty hose has long been known, and a wide variety of designs for such hosiery have been proposed. Such undergarments generally cover the waist, legs, and optionally the feet of the wearer. See, for example, Harper U.S. Pat. No. 4,133,054, issued June 9, 1979, Appleton U.S. Pat. No. 256,532, issued Apr. 18, 1882, and Artzt U.S. Pat. No. 2,664,570, issued Jan. 5, 1954. Such hosiery is often knitted on a circular knitting machine and then assembled from a pair of tubular knitted blanks.

Some such garments provide separate stocking and panty portions which are sewn together at a seam (e.g., Rice U.S. Pat. No. 2,826,760, issued Mar. 18, 1958) or knitted together continuously (e.g., Safrit et al., U.S. Pat. No. 4,213,312, issued Jul. 22, 1980). Elastic fabrics such as spandex have been incorporated into the panty portion of such garments to provide a "control top" at the waist or belly, and to impart a decorative pattern to the garment. See, in particular, Cassidy, Sr. U.S. Pat. Nos. 3,933,013, issued Jan. 20, 1976, and 3,956,906, issued May 18, 1976. Reinforced waistbands for panty hose are also well known, as exemplified by Cassidy, Sr. U.S. Pat. No. 4,150,554, issued Apr. 24, 1979. Women's nylons have also been provided with reinforced heel and toe portions. See the Harper patent cited above, and Taylor U.S. Pat. No. 1,227,217, issued May 22, 1917.

Long underwear and athletic undergarments which cover the lower half of the body, sometimes excluding the feet, are also well known. Note, for example, Kearn U.S. Pat. No. 4,091,466, issued May 30, 1978. In an early design, a sock is releasably secured to a stocking so that it could be removed and replaced when soiled or worn beyond use (Ryan U.S. Pat. No. 319,131, issued June 2, 1885). Another known garment provides a pair of athletic socks which are sewn to the bottom ends of the stocking portions of a support hose undergarment. See White U.S. Pat. Nos. 4,368,546, issued Jan. 18, 1983, and 4,506,392, issued Mar. 26, 1985.

Knitting has long been a favored method for making undergarments, stockings and socks. Many knitting techniques are known for producing stripes, raised ribbing, and other decorative patterns in socks and similar garments. See, e.g., Keziah U.S. Pat. No. 3,194,030, issued Jul. 13, 1965. Computer-controlled circular knitting machines can provide a sock having an elaborate design thereon. The design is created using computer graphics, and the graphic image of the desired design is then automatically knitted by the machine. One such machine is the Magica Colosio from Cesare Colosio s.r.l, Italy.

With the exception of long underwear and certain athletic undergarments, modern panty hose has been designed exclusively for women. Women's panty hose offer a number of advantages over long underwear currently sold to men. Panty hose is relatively light weight as compared to long underwear, and is made with sufficent elasticity to resiliently support the legs. Such support can improve blood circulation in the legs, especially in older persons. Long underwear is also bulky and difficult to wear under other clothing as compared to panty hose.

In cold climates, women commonly wear panty hose under jeans or other pants for additional warmth and body support without restrictive bulkiness. Some men, particularly men in need of extra leg support, have tried wearing women's panty hose under their clothing. Since men wish to avoid being seen wearing a garment designed for women, they will typically wear regular or support socks over the foot portion of the panty hose.

Such use by men of women's panty hose has proven unsatisfactory in practice. The panty hose fits poorly because it is configured to the shape of a woman's body, not a man's. High top socks (knee socks) tend to sag when worn over panty hose made of a synthetic fabric such as nylon unless the socks have a tight, relatively thin top elastic band. Such a tight thin band is uncomfortable and can defeat the circulation-improving effects of the support hose. Men who wear ordinary socks over support hose for long periods also risk blistering of the feet due to sliding contact between the two unattached sock layers. Moreover, the synthetic fabric of the support hose has poor moisture transmitting characteristics. This causes perspiration to collect between the foot and the fabric of the support hose. Men thus have no garment comparable to women's panty hose which is free of the foregoing disadvantages.

SUMMARY OF THE INVENTION

The present invention provides a one-piece undergarment suitable for use by men. An undergarment according to the invention includes an underpant portion including a pair of leg openings, a pair of knitted leg portions made of a resilient fabric, and a pair of reinforced sock portions continuously knitted with the leg portions at respective ends thereof remote from the leg openings. According to one aspect of the invention, the underpant portion includes an elastic waistband, a central crotch portion, and a fly. According to an additional aspect of the invention, an additional resilient band is provided above the waistband to provide belly support.

An alternative embodiment of the invention provides an additional outer sock which is secured toe-to-toe with the undergarment and can be doubled over the sock portion of the undergarment for extra warmth.

BRIEF DESCRIPTION OF THE DRAWING

The invention will now be described with reference to the accompanying drawing, wherein like numerals denote like elements, and.

DETAILED DESCRIPTION

Figure 1:
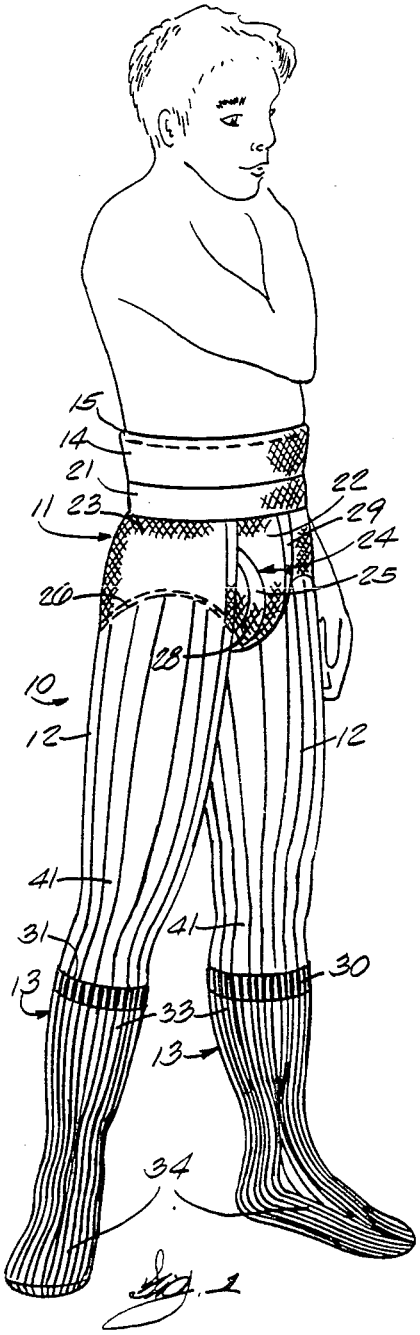
FIG. 1 is a perspective view of an undergarment according to the invention being worn by a man.
Figure 2:
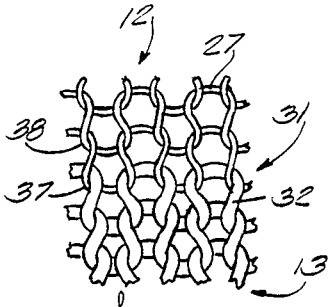
FIG. 2 is an enlarged partial view of the upper edge of the sock portion shown in FIG. 1.
Figure 3:
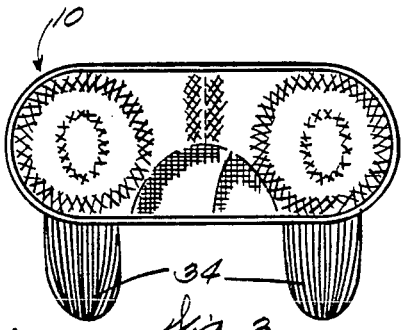
FIG. 3 is a top plan view of the undergarment shown in FIG. 1.

Referring now to FIGS. 1, 2 and 3 of the drawing, an undergarment 10 according to the invention includes an underpant portion 11, a pair of leg portions 12, a pair of sock portions 13, and an elastic top band 14. Each of these portions of undergarment 10 will be hereafter described in detail.

As illustrated in FIGS. 1 and 3, underpant portion 11 generally resembles conventional men's briefs. Underpant portion 11 includes a waistband 21 preferably made of conventional elastic material and having a width of about 4 cm or less. Waistband 21 adjoins a central crotch portion 22 and a hip covering portion 23, the latter of which constitutes the main part of the underpant below waistband 21 on either side of crotch 22. Crotch portion 22 comprises a pair of cloth pieces which overlap to define a fly 24. Fly 24 and crotch 22 may be omitted if desired, for example, for an undergarment according to the invention to be worn by women. Crotch 22 is preferably made of cotton or a blend of cotton and a synthetic fabric such as nylon to provide greater air circulation in the crotch area. Crotch 22 has side edge welts 28, 29 to provide added strength at the locations where the crotch patch is sewn to hip covering portion 23, and an additional welt 25 along the edge of fly 24.

Leg (stocking) portions 12 extend downwardly from leg openings 26 of underpant portion 11 shown by dotted lines in the embodiment of FIG. 1. Leg portions 12 preferably extend below the knee area but end above the ankles. Leg portions 12 may advantgeously be continuously knit with hip portions 23, or may be separately knit and then sewn thereto. Both hips 23 and leg portions 12 are preferably made of light-weight, resilient natural or synthetic fabrics such as nylon, lycra, spandex, silk, and combinations thereof. To provide a suitable weight and feel, hips 23 and leg portions 12 should be made of a yarn (or yarns) 27 in the range of about 10 to 60 denier, most preferably from about 20 to 40 denier. In the alternative, a reinforced underpant portion 11 may be made by using a heavier yarn (or yarns) to make underpant portion 11 down to leg openings 26. For purpose a yarn of a larger denier, preferably 50 to 150 denier, especially 60 to 80 denier, is employed.

An upper edge 31 of each of sock portions 13 is created by changing to a heavier yarn during knitting at the desired point. A yarn 32 of a larger denier, preferably 50 to 150 denier, especially 60 to 80 denier, is employed. This can be done by, for example, doubling the yarn beginning at edge 31 to include a second yarn in addition to the yarn used to make leg portions 12, so that the total denier of both yarns together is within the foregoing ranges. Orlon yarn is especially useful as such a second yarn because it provides good moisture and air circulation in sock portions 13. If different yarns are used in successive courses, for example, a heavier yarn and a lighter yarn are used in alternate courses, then the foregoing denier ranges refer to the average total denier of the portion, i.e., the sock 13, leg 12, or underpant 11.

Leg portions 12 should have an average yarn denier which is at least about 10 denier, preferably 20 denier, most preferably 40 to 70 denier less than the average yarn denier of the sock portion 13. If a reinforced underpant portion is needed, leg portions 12 should have an average yarn denier which is at least about 10 denier less than the average yarn denier of hip covering portion 23. These differences insure that the sock and underwear portions 11, 13 are sufficiently reinforced, that is, have greater thickness, warmth and/or durability than leg portions 12. Various combinations of commercially available nylon with orlon or spandex yarns may be used to make leg portions 12.

Each sock 13 includes an elongated, generally tubular upper portion 33 which covers the wearer's calf, and a lower foot portion 34 which can optionally include heel and toe reinforcement. Upper portion 33 can include ribbing 36 which is knit into the sock portion in a conventional manner, or a decorative pattern such as argyle (not shown) made by varying the color of the yarn and using well known knitting techniques for making such patterns, such as intarsia or fair-isle.

As shown in FIG. 2, both leg and sock portions 12, 13 may be knit using conventional stockinette stitch. At edge 31, yarn 32 of topmost course 37 of sock portion 13 is knitted to yarn 27 of the bottommost course 38 of leg portion 12. This eliminates the need for an unsightly sewn seam at edge 31. Leg portions 12 are preferably a different color from sock portions 13 In particular, leg portions 12 are preferably colored, for example, light blue, black, gray, or white, and may be of the appearance to be made of stone-washed fabric such as denim. Sock portions are preferably some other color, such as black, white, patterned (as shown), a primary color, or the like. Undergarment 10, or portions thereof, may be of stone-washed or military camouflage design to provide a more masculine appearance.

Tubular portion 33 of sock 13 preferably extends far enough so that leg portions 12 cannot be seen when undergarment 10 is worn under long pants. Thus, edge 31 is generally in close proximity, e.g. within about 7–13 cm, of the knee 41 of leg portions 12. Thus, the total length of sock portion 12 when laid out flat and straight (from toe to edge 31) is generally about 1/5 to $\frac{1}{3}$ the total length of the remainder of undergarment 10 (from edge 31 to the top of waistband 21).

Each sock 13 may further include a somewhat elastic band 30 at its top to prevent sagging of sock 13. Band 30 is typically rendered resilient by including extra spandex yarn in band 30, and has ore elasticity than the remainder of sock 13 or the leg portions 12. Band 30 should have a width of at least about 2 cm, especially from 2 to 8 cm, to avoid the constricting effects of thin, more highly elastic bands.

Referring again to FIG. 1, undergarment 10 may further include a top tubular elastic band 14 sewn or knitted above waistband 21. Band 14 is preferably made of spandex or similar material which resiliently hugs the wearer in the manner of control top panty hose for women. Band 14 encircles the wearer and generally extends from the wearer's waist to the wearer's rib cage. For this purpose, band 14 has a constant width in the range of about 2 to 11 cm, especially 7 to 11 cm. Band 14 may include a light, thin, sewn-in band of elastic 15 near its top edge for holding up band 14.

Figure 4:
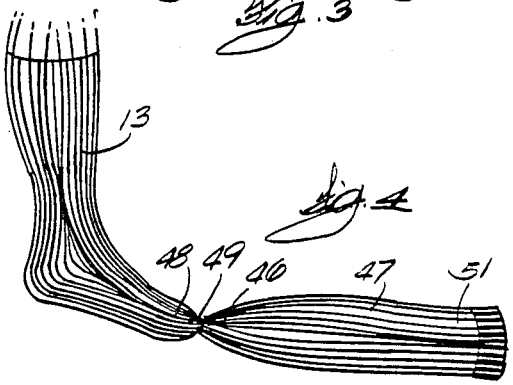
FIG. 4 is a partial perspective view of an alternative embodiment of an undergarment according to the invention.
Figure 5:
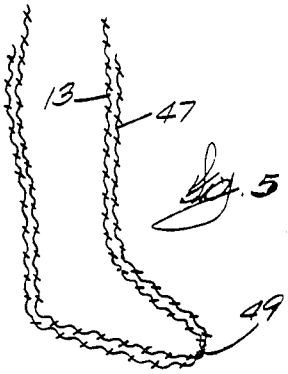
FIG. 5 is a partial sectional view of the embodiment shown in FIG. 4 in a doubled-over condition.

FIGS. 4 and 5 illustrate an alternative embodiment of the invention wherein the toe end 46 of an extra sock 47 is secured to the toe end 48 of each sock portion 13 by suitable means, such as a stitch or fish-mouth seam 49. As shown in FIG. 5, sock 47 is turned outside in and drawn up over sock portion 13 to provide a double sock as shown. This embodiment provides additional warmth for the feet, and has the advantage that socks 47 are attached to undergarment 10 and thus cannot be lost or misplaced. Socks 47 can have lengthwise ribbing 51 and/or a band 30 at the ends thereof remote from toe ends 46 made of a resilient stretchable material to aid in keeping outer socks 47 from slipping down outside of inner socks 13. Socks 47 are typically made of the same material as sock portions 13, are of the same color, and have generally the same dimensions as socks 13.

Undergarment 10 may be manufactured by the following method. A pair of seamless tubular hosiery blanks are first knitted using a circular knitting machine. Each blank extends the entire length of undergarment 10 in the lengthwise direction and includes part of underpant portion 11 (and top band 14, if present) and a corresponding leg 12, sock 13, and outer sock 47 (if used) for the left and right sides, respectively. The yarns used are varied during knitting to provide reinforcement and color variation as described above for underpant portion 11 (if used) and sock portions 13.

The blanks are then closed at the toe with a fish-mouth seam, and may have knit or boarded heel and toe pockets. If an outer sock 47 is to be included, the blank is drawn together and sewn at seam 49 to form the toe portions of respective socks 13, 47. In the alternative, a pair of separate socks 47 may be sewn onto toes ends 48. The blanks are then shaped by placing each blank on a hosiery boarding form and heat setting to obtain the desired shape. Each identical blank is then cut at its upper end, and the blanks are sewn together along a central seam 52 (see FIG. 3). Waistband 21 may be made, if not knitted as part of the blanks, by doubling the upper edge of underpant portion 11 over a separate band of elastic and sewing the edge to itself to form a welt enclosing the elastic. If desired, a patch including crotch and fly portions 22, 24 is sewn in between the blanks on the front side of the garment along a pair of seams 53, 54 which diverge from seam 52, as shown in FIG. 3.

An undergarment according to the foregoing embodiment of the present invention can provide men with extra warmth and leg support without restrictive bulkiness. It combines socks, underwear and leg-covering stockings into a single garment, eliminating the need to put on three separate garments, i.e., underwear, socks, and tights or panty hose. The sock portion is continuously knitted with the legs of the undergarment, avoiding the need for unsightly stitching at the top of the sock, and keeping the sock from sagging at all times. The sock portion, if made elastic, does not require a thin, constricting elastic band at the top of the sock. Running is generally not a problem with the undergarment according to the invention because the yarns used are generally heavier than the yarns used in women's panty hose.

It will be understood that the above description is of preferred examples of the invention, and that the invention is not limited to the specific forms shown. Modifications may be made in the design and arrangement of the elements without departing from the scope of the invention as expressed in the appended claims.

I claim:

1. A one-piece undergarment, comprising.

an underpant portion having a pair of leg openings;

a pair of knitted leg portions made of a resilient fabric secured to said leg openings; and a pair of sock portions continuously knitted with said leg portions at respective ends thereof remote from said leg openings, and made of a heavier fabric than said leg portions a pair of outer socks, means for securing said outer socks at respective toe ends thereof with a tow end of each of said sock portions, each of said outer socks being capable of being doubled over said sock portions when said undergarment is worn.

2. The undergarment of claim 1, further comprising a tubular elastic band adjoining said underpant portion at the end thereof remote from said leg openings for hugging the belly of a wearer.

3. The undergarment of claim 2, wherein said elastic band has a width in the range of from about 2 to 11 cm.

4. The undergarment of claim 1, wherein said leg portions are knitted from one or more yarns of about 10 to 60 average total denier, said sock portions are knitted from one or more yarns of about 50 to 150 average total denier, the total average denier of said leg portion yarn being at least about 20 denier less than the total denier of said sock portion.

5. The undergarment of claim 2, wherein said hip covering portions are continuously knitted with said leg portions.

6. The undergarment of claim 5, wherein said hip covering portion, said leg portion and said sock portion are made of a resilient fabric, and said crotch is made of a substantially non-resilient fabric which admits air more readily than said resilient fabric.

7. The undergarment of claim 6, wherein said crotch comprises a patch sewn to said hip covering portion.

8. A one-piece undergarment, comprising:

an underpant portion having a pair of leg openings;

a pair of leg portions secured to said leg openings;

a pair of inner socks secured to said leg portions at respective ends thereof remote from said leg openings;

a pair of outer socks; and means for securing said outer socks at respective toe ends thereof with a toe end of each of said inner socks, each of said outer socks being capable of being doubled over said inner socks when said undergarment is worn.

9. The undergarment of claim 8, wherein said underpant portion includes an elastic waistband, a hip covering portion, and a crotch portion having a fly.

* * * * *

UNITED STATES PATENT AND TRADEMARK OFFICE

CERTIFICATE OF CORRECTION

PATENT NO. : 4,870,708

DATED : October 3, 1989

INVENTOR(S) : William L. Staley

It is certified that error appears in the above-identified patent and that said Letters Patent is hereby corrected as shown below:

In the drawings, Fig. 3, reference numerals 53 and 54 should be applied to the right and left hand segments, respectively, of the semi-circular seam shown in dotted lines. Reference numeral 52 should be applied to the central seam shown in dotted lines projecting vertically from the semi-circular seam. Column 4, line 39, "ore" should read --more--. Col. 6, claim 1, line 10, "tow" should read --toe--.

Signed and Sealed this

Twenty-ninth Day of January, 1991

*Attest:*

HARRY F. MANBECK, JR.

*Attesting Officer*

*Commissioner of Patents and Trademarks*